United States Patent [19]

Dijkstra et al.

[11] Patent Number: 4,498,296

[45] Date of Patent: Feb. 12, 1985

[54] THERMODYNAMIC OSCILLATOR WITH AVERAGE PRESSURE CONTROL

[75] Inventors: Kees Dijkstra; Andreas J. Garenfeld, both of Eindhoven, Netherlands

[73] Assignee: U.S. Philips Corporation, New York, N.Y.

[21] Appl. No.: 525,907

[22] Filed: Aug. 24, 1983

[30] Foreign Application Priority Data

Jul. 1, 1983 [NL] Netherlands ..... 8302337

[51] Int. Cl.[3] ..... F02G 1/06

[52] U.S. Cl. ..... 60/521; 60/520; 62/6

[58] Field of Search ..... 60/517, 520, 521, 525; 62/6

[56] References Cited

U.S. PATENT DOCUMENTS

| | | | |
|---|---|---|---|
| 2,794,315 | 6/1957 | Meijer | 60/521 |
| 2,867,973 | 1/1959 | Meyer | 60/521 |
| 3,902,321 | 9/1975 | Bergman | 60/521 |

*Primary Examiner*—Stephen F. Husar
*Attorney, Agent, or Firm*—David R. Treacy

[57] ABSTRACT

A thermodynamic oscillator having a displacer (5) and a piston (3) (further displacer) movable due to pressure fluctuations at the resonance frequency of the oscillator. The displacer (5) and the piston (3) are located in a working space (11, 15) which is filled with working medium and can be connected through a release valve (51, 125, 167) and a supply valve (53, 129, 169), respectively, to simple reservoir (55) filled upon working medium with an increase and a decrease, respectively, of the ambient temperature with respect to a nominal temperature. The valves (51, 53, 125, 129, 167, 169) have an opening pressure which is a function of the ambient temperature. The average pressure and the resonance frequency of the oscillator can thus be stabilized at a variable ambient temperature.

The oscillator can be operated as a cold-gas engine, a hot-gas engine (motor), a heat pump or a current generator.

10 Claims, 9 Drawing Figures

THERMODYNAMIC OSCILLATOR WITH AVERAGE PRESSURE CONTROL

BACKGROUND OF THE INVENTION

The invention relates to a thermodynamic oscillator having at least one displacer which is displaceable in a working space filled with the working medium, at the resonance frequency of the oscillator. The displacer divides the working space into an expansion space and a compression space of different substantially constant temperatures, which communicate with each other via a regenerator, the movement of the displacer due to pressure fluctuations in the working medium being coupled to a piston or a further displacer, respectively, which is also displaceable in the working space. The working space is connected via at least one release valve and at least one supply valve to a reservoir which is filled with the same working medium as that of the working space and whose pressure lies between a maximum and a minimum working pressure of the working medium.

On page 270–273 of the book "Stirling Engines" of 1980 by G. Walker (ISBN 0-19-856209-8), a thermodynamic oscillator of the kind mentioned in the opening paragraph has been described. This known oscillator has a so-called central position control for the piston, whereby the consequence of working medium leaking between the compression space and a gas buffer space forming part of the working space and compensated for by means of connections between these spaces and reservoirs in which a pressure prevails which is comparatively low with respect to the average working pressure. One connection comprises two release valves in series arrangement for blowing off the compression space through a first reservoir to the gas buffer space for compensating leakage from the gas buffer space to the compression space. The other connection comprises two supply valves in series arrangement for supplementing working medium to the compression space through a second reservoir from the gas buffer space for compensating leakage from the compression space to the gas buffer space. Therefore, the original central position of the piston is maintained in the case of leakage bothe in one and in the other direction. G. Walker has given no information about the mechanical prestress of the release and supply valves. However, it has to be assumed that the valves are biased by only a comparatively low mechanical pre-stress if it is to be possible for a sufficient compensation for leakage to be obtained. At any rate, it is clear that a variation of the ambient temperature in the known oscillator does not offer compensation for the resulting variation of the average work pressure. As a result of this, the thermodynamic spring constant of the work-medium and hence the resonance frequency of the known oscillator varies with the varying ambient temperature. The resulting variation of the phase difference between the movements of the displacer and the piston leads to a varying efficiency which is not an optimum.

SUMMARY OF THE INVENTION thermodynamic oscillator with the a control for the average working pressure with varying ambient temperature.

A thermodynamic oscillator according to the invention is therefore characterized in that the release valve and the supply valve are arranged in the connection between one single reservoir and the working space, while opening pressure of the supply valve have a value which is a function of the ambient temperature, the opening pressure of the release valve being equal to the sum of the mechanical pre-stress of the release valve and the reservoir pressure, while the opening pressure of the supply valve is equal to the difference between the reservoir pressure and the mechanical pre-stress of the supply valve.

It should be noted that the opening pressure of bothe valves is that working pressure at which the relevant valves start to open.

In the case in which the ambient temperature increases, the average working pressure in the oscillator also increases. By a suitable choice of the opening pressure of the release valve, the effect of the increase of the ambient temperature on the average working pressure is compensated for by blowing off from the working space to the reservoir. The opening pressure of the release valve must therefore have a value which is a function of a predetermined value of the ambient temperature. The procedure is the same for the supply valve with the a decrease of the ambient temperature below a predetermined value. Since the pressure in the reservoir lies between the maximum value and the minimum value of the working pressure in the oscillator, blowing off from the working space and supplementation to the working space are invariably guaranteed.

It should be noted that an increase or a decrease of the ambient temperature is to be understood herein to mean an increase or a decrease with the respect to the so-called nominal ambient temperature, for which the oscillator has been designed.

In a particular embodiment of the oscillator, the sum of the mechanical pre-stress of the release valve and the mechanical pre-stress of the supply valve is constant. Such a control is a very simple construction and is especially suitable for use in those oscillators in which the so-called pressure sweep of the working pressure is constant. A constant pressure sweep or a constant pressure variation occurs in oscillators which have no amplitude control.

A further embodiment of the oscillator is characterized in that the release valve and the supply valve are pre-stressed by a mechanical spring common to bothe valves, while a restriction is provided in the connection between the working space and the reservoir. The use of one spring for bothe valves leads to a simple and compact construction which is particularly suitable for oscillators having a constant pressure sweep.

A still further embodiment of the oscillator is characterized in that the valves which are pre-stressed by a common spring co-operate with the an operating slide which near its one end is secured to a first bellows and near its other end is secured to a second identical bellows, whereby the same pressure prevails inside the two bellows, while the working pressure or the average working pressure prevails outside the first bellows and a vacuum prevails outside the second bellows. The use of an operating slide driven by two bellows for the two valves yields a substantially symmetrical construction.

A further embodiment of the oscillator is characterized in that the ratio between the two mechanical prestresses depends upon the difference between a nominal value of the ambient temperature and the actually occurring ambient temperature. This embodiment is particularly suitable for oscillators having an amplitude control. In oscillators having an amplitude control, the pressure sweep of the oscillators also varies with the the amplitude. If in this case the pre-stresses of the release valve and the supply valve would have a constant value, blowing-off would not occur with the an increased ambient temperature and a comparatively small pressure sweep of the oscillator. A supplementation would not occur either with the a decrease ambient temperature and a comparatively small pressure sweep. When, however, the ratio between the pre-stresses of the two valves is adapted to the difference between the nominal ambient temperature and the actual ambient temperature, a satisfactory control of the average working pressure is obtained also for amplitude-controlled oscillators.

A still further embodiment of the oscillator is characterized in that each of the valves is pre-stressed by an individual mechanical spring, the stiffness of the two springs being equal. The embodiment provided with the two springs is particularly suitable for oscillators having a variable pressure sweep.

Still another embodiment of the oscillator is characterized in that the mechanical spring is a bimetal spring which is in heat-exchanging contact with the the ambient atmosphere. Such an oscillator is very suitable for use with the a variable pressure sweep. The bimetal springs render individual valve springs superfluous and further provide an adaptation of the pre-stresses of the valves with the varying ambient temperature. In fact the bimetal spring is a valve spring with the a self-correcting pre-stress.

A further embodiment of the oscillator is characterized in that the two springs are coupled to one bellows which co-operates with the an operating member, whereby a vacuum prevails within the bellows and the pressure of the reservoir prevails outside the bellows. This oscillator comprising two springs and one bellows is an alternative for the oscillator comprising one spring and two bellows described already and is further particularly suitable for an oscillator having a variable pressure range.

Still another embodiment of the oscillator is characterized in that the oscillator is a cold-gas engine comprising one free displacer which divides the working space into a compression space of comparatively high temperature and an expansion space of comparatively low temperature, the movement of the free displacer due to pressure fluctuations in the working medium being coupled to a piston which is displaceable in the working space and is driven by a linear electric motor. This oscillator constructed as a cold-gas engine has a substantially constant cold output with the varying ambient temperature.

A further oscillator is characterized in that the oscillator is a hot-gas engine comprising one free displacer which divides the working space into a compression space of comparatively low temperature and an expansion space of comparatively high temperature, the movement of the free displacer due to pressure fluctuations in the working medium being coupled to a piston which is displaceable in the working space and is coupled to a mechanical load. The oscillator constructed as a hot-gas engine (motor) supplies a substantially constant driving torque with the varying ambient temperature.

The invention will be described more fully with the reference to the drawing.

DESCRIPTION OF THE PREFERRED EMBODIMENTS

Figure 1:
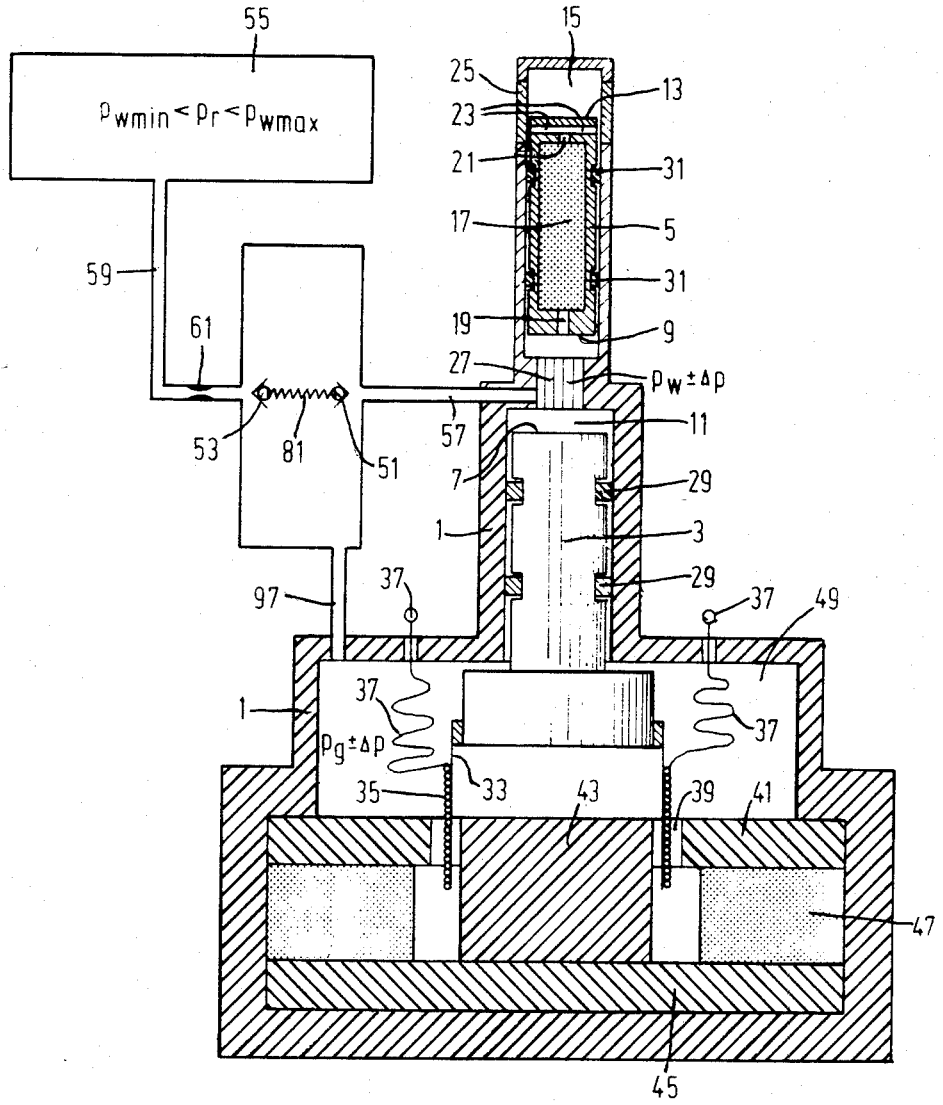
FIG. 1 is a diagrammatic sectional view of an oscillator constructed as a cold-gas engine or current generator.

The oscillator shown in FIG. 1 and constructed as a cold-gas engine has a cylindrical housing 1 which is filled with the a gaseous working medium, such as, for example, helium and in which are arranged a piston 3 displaceable at the resonance frequency of the oscillator and a free displacer 5 displaceable at the resonance frequency of the oscillator. The movements of the piston 3 and the displacer 5 are relatively shifted in phase. A compression space 11 of substantially constant comparatively high temperature is present between the working surface 7 of the piston 3 and the working surface 9 of the displacer 5. The upper working surface 13 of the displacer 5 limits an expansion space 15 of substantially constant comparatively low temperature. The compression space 11 and the expansion space 15 together constitute the working space of the oscillator. The displacer 5 includes a regenerator 17 through which working medium passes via a central bore 19 on the lower side and via a central bore 21 and radial ducts 23 on the upper side. The oscillator has a freezer 25 which serves as a heat exchanger between the expanding cold working medium and an object to the cooled, and a cooler 27 which serves as a heat exchanger between the compressed hot working medium and a coolant. Annular gaskets 29 are arranged between the piston 3 and the housing 1. Annular gaskets 31 are arranged between the displacer 5 and the housing 1. The piston 3 is driven by a linear electric motor which has a sleeve 33 which is secured to the piston and on which an electrical coil 35 with the connections 37 is provided. The coil 35 is displaceable in an annular gap 39 between a soft-iron ring 41 and a soft-iron cylinder 43. An axially polarized permanent ring magnet 37 is arranged between the ring 41 and a soft-iron disk 45. The oscillator described so far is of a well-known type (for example, see U.S. Pat. No. 3,991,585), whose operation is also well known.

It is assumed that in the working space, 11,15 a working pressure $p_w$ prevails which lies between a maximum value $p_{w\,max}$ and a minimum value $p_{w\,min}$ at the nominal ambient temperature for which the oscillator is designed. The so-called pressure range is therefore $p_{w\,max}-p_{w\,min}$. An average working pressure $p_g$ prevails in the space 49 below the piston 3. Withe an increase of the ambient temperature above the nominal value, an increase in pressure $+\Delta p$ occurs in the working space 11,15 and in the buffer space 49. The pressure in the working space 11,15 is then $p_w+\Delta p$ and the pressure in the buffer space 49 is equal to $p_g+\Delta p$. An increase of pressure in the working space 11,15 leads to an increase of the thermodynamic spring constant. This causes the oscillator to be resonant at a frequency different from the optimum resonance frequency, so that a phase variation occurs between the movement of the piston 3 and that of the displacer 5. The cold production of the oscillator is then no longer an optimum. An analogous situation occurs with the a decrease of the ambient temperature below the nominal temperature. In order to compensate for variations of the working pressure $p_w$ with the a varying ambient temperature, the working space 11,15 of the oscillator according to the invention is connected via a release valve 51 and a supply valve 53 to a reservoir 55 in which prevails a pressure $p_r$ lying between $p_{w\,max}$ and $p_{w\,min}$. The release valve 51 has connected to it a pipe 57 which is connected at the level of the cooler 27 to the compression space 11. The supply valve 53 is connected via a pipe 59 to the reservoir 55. The pipe 59 is provided with the a restriction 61.

Figure 2:
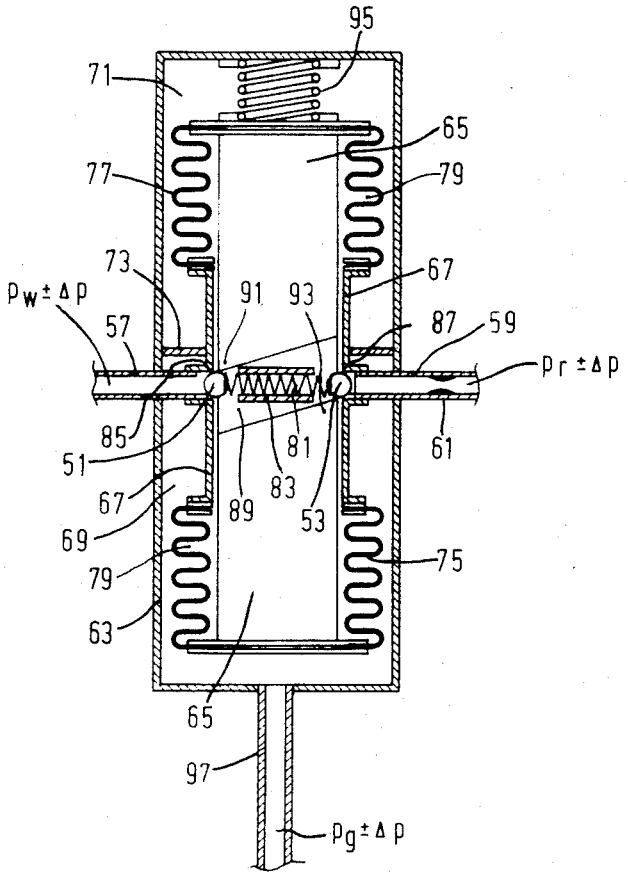
FIG. 2 shows in detail a sectional view of a valve mechanism comprising a common spring used in the oscillators of the kind shown in FIGS. 1 or 5.

The operation of the valves 51 and 53 is explained more fully with the reference to FIG. 2, which is provided with the reference numerals corresponding to those of FIG. 1. The valves 51 and 53 are situated in a cylindrical housing 63 in which a cylindrical operating slide 65 is arranged which is guided in a cylindrical guide 67. The housing 63 is divided into a first chamber 69 and a second chamber or space 71 which are mutually separated by a gas-tight partition wall 73. The guide 67 is connected at its end located in the chamber 69 to a first bellows 75 which is secured to the end of the operating slide 65 located in the chamber 69. The guide 67 is connected at its end located in the chamber 71 to a second bellows 77 which is secured to the end of the operating slide 65 located in the chamber 71. There is arranged between the bellows 75 and 77 and the operating slide 65 a third chamber 79 which, when the valves 51 and 53 are closed, is cut off from the pipes 57 and 59. The valves 51 and 53 are slightly prestressed by a common mechanical helical spring (compression spring 81 which is guided in a tube 83 which prevents the spring 81 from buckling. The ball valves 51 and 53 engage valve seats 85 and 87 which are formed in the pipe 67. The operating slide 65 is provided with the a recess 89 which is at an acute angle to the longitudinal direction of the slide and which accommodates the valves 51 and 53, the spring 81 and the tube 83. Due to the form of the recess 89, two lifting wedges 91 and 93 are formed in the operating slide 65, which wedges serve to render one of the valves 51 and 53 alternately inoperative.

A vacuum prevails in the chamber 71, which means that at any temperature in the chamber 71 the same gas pressure (zero) is exerted on the outer side of the second bellows 77. At a pressure in the pipes 57 and 59, which does not exceed the pre-stess of the spring 81, and at an equal pressure in the first chamber 69 and the third chamber 79, the operating slide 65 is in the neutral position shown in FIG. 2. This is ensured by a mechanical helical spring (compression spring) 95 which is arranged between the housing 1 and the operating slide 65 and is biased by given pre-stress dependent upon the average working pressure $p_g$.

The first chamber 69 is connected through a pipe 97 to the buffer space 49 (see FIG. 1). At the nominal ambient temperature $T_n$, the average working pressure $p_g$ prevails in the buffer space 49 and hence in the first chamber 69. Instead of being connected to the buffer space 49, the pipe 97 may alternatively be connected to the working space 11, 15. However, it is then necessary to provide a restriction in the pipe 97 in order to prevent the pressure in the first chamber 69 from following the fluctuations of the working pressure.

Figure 3:
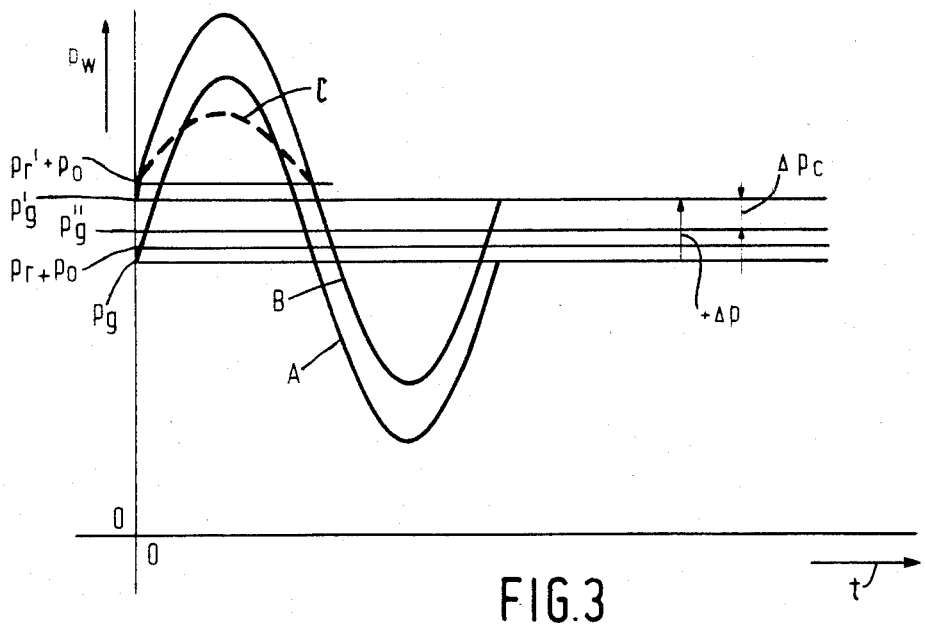
FIG. 3 is a graph in which the working pressure is plotted as a function of time for an oscillator operating with the a constant pressure sweep of the kind shown in FIG. 1 or FIG. 5 with the an increased ambient temperature.
Figure 4:
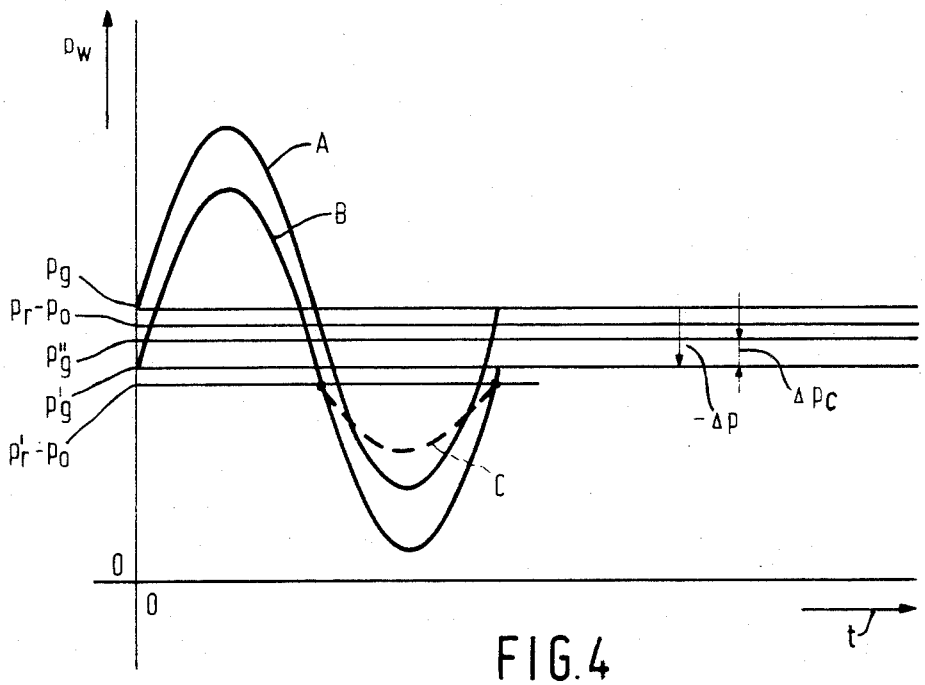
FIG. 4 is a graph in which the working pressure is plotted as a function of time for an oscillator operating with the a constant pressure sweep of the kind shown in FIG. 1 or FIG. 5 with the a decreased ambient temperature.

The operation of the pressure-controlled oscillator will be described with the reference to FIGS. 3 and 4, in which the working pressure is plotted as a function of time. The graph of FIG. 3 relates to an increase of the ambient temperature and that of FIG. 4 to a decrease of the ambient temperature. It is assumed that the oscillator shown in FIGS. 1 and 2 operates with the a constant pressure sweep ($p_{w\,max}-p_{w\,min}$=constant) at an average working pressure $p_g$ for the nominal ambient temperature $T_n$, for which the oscillator is designed. The low pre-stress of the spring 81 is indicated in FIGS. 3 and 4 by the reference symbol $p_o$. The pressure in the reservoir 55 is indicated by the reference symbol $p_r$.

In the situation of an increase of the ambient temperature shown in FIG. 3, only the release valve 51 becomes operative, while the supply valve 53 is rendered inoperative. The increase of the ambient temperature leads to an increase of the average pressure $p_g$ in the buffer space 49 by an amount $\Delta p$. This means that also the pressure in the first chamber 69 is increased by an amount $\Delta p$. Since a vacuum continues to prevail in the second chamber 71 and the pressure inside the bellows 75 and 77 in the third chamber 79 has no effect on the operating slide 65, the operating slide 65 will move upwards (in FIG. 2) and will consequently remove the supply valve 53 from its seat 87 by means of the wedge 93. The valve 53 engages the inner wall of the guide 67 in a region outside the connection between the pipes 57 and 59 and is then inoperative. The spring 81 is then slightly compressed and subsequently stretched again. The recess 89 is proportioned so that the release valve 51 does not touch the operating slide 65 and therefore remains operative.

In FIG. 3, a curve A indicates the pressure variation at the nominal ambient temperature $T_n$. The average working pressure is then $p_g$. The curve B indicates the pressure variation with the an increase in pressure $\Delta p$. The average working pressure is now $p_g'$, while the reservoir pressure is $p_r'=p_r+\Delta p$. Since the sum of the pre-stress $p_o$ of the release valve 51, which is constant, and the pressure $p_r'$ of the reservoir 55 is exceeded by $p_w$, working medium will be blown off through the opened release valve 51 from the compression space 11 via the pipe 57, the recess 89 and the pipe 59 to the reservoir 55, which is at a pressure lying between the maximum and the minimum working pressure. The restriction 61 prevents the working pressure in the working space 11, 15 from being reduced too much. The effect of the blowing-off process is indicated in FIG. 3 by the dotted line C. The average working pressure decreases by an amount $\Delta p_c$ to the corrected average working pressure $p''_g$.

FIG. 3 represents only one operating cycle of the oscillator. It will be clear that with the following operating cycles, the blowing-off process will be continued as long as the maximum working pressure exceeds the sum of the pre-stress $p_o$ and the pressure $p_r'$ of the reservoir. This sum of the pre-stress $p_o$ and the reservoir pressure $p_r'$ is the opening pressure of the release valve 51, which, due to the reservoir pressure $p_r'$, is consequently a function of the ambient temperature. A new working pressure will ultimately be adjusted, which approaches the original average working pressure so that $\Delta p_c \approx \Delta p$. The resonance frequency of the oscillator is thus stabilized so that an optimum cold production is guaranteed.

An analogous situation arises with the a decrease of the ambient temperature below the nominal temperature $T_n$. The opening pressure of the supply valve 53 is equal to the difference between the reservoir pressure $p_r'$ and the pre-stress $p_o$. FIG. 4 indicates for this case with the the reference symbols C and $\Delta p_c$ the effect of the pressure control. During supplementation from the reservoir 55 to the working space 11, 15, the operating slide 65 has rendered the release valve 51 inoperative due to a decrease in pressure $\Delta p$ in the buffer space 49 by means of the wedge 91 which has been displaced downwards. It should be noted that during blowing-off and supplementation, respectively, the pressure in the reservoir 55 is increased and decreased, respectively. However, the pressure in the reservoir 55 lies invariably between the maximum and the minimum working pressure so that blowing-off and supplementation are constantly possible. The restriction 61 acts in bothe directions so that during supplementation the average pressure in the working space 11, 15 is prevented from increasing too much.

The pressure control described above and to be described below is an optimum only in a given temperature range which can be derived from the following approximation formula:

$$\Delta T_{max} = T_n \cdot \frac{\frac{V_r}{V_o}}{1 + \frac{V_r}{V_o}} \cdot \frac{p_{max} - p_{min}}{P_g}$$

in which:

$\Delta T_{max}$ is the maximum temperature range of the ambient temperature for which the control has an optimum effect, $T_n$ is the nominal ambient temperature, $V_r$ is the volume of the reservoir 55, $V_o$ is the gas volume of the oscillator, $p_{max}$ is the maximum working pressure at $T_n$, $p_{min}$ is the minimum working pressure at $T_n$, $p_g$ is the average working pressure at $T_n$.

It should be appreciated that, among other things, an increase of the volume $V_r$ of the reservoir 55 with the respect to the volume $V_c$ of the oscillator causes an increase of the temperature range.

In the present case, the following data apply to the oscillator:

$T_n = 283°$ K.

$V_r / V_o = 1$ $p_{max} = 26.67$ atm.

$p_{min} = 13.33$ atm.

$p_g = 20$ atm.

The temperature range which follows from the formula and for which the control has an optimum effect is therefore about 94.9° K.

Since $T_{max}$ satisfies the relation:

$$T_{max} = \frac{\left[V_o + \frac{p_{max}}{p_g} \cdot V_r\right]}{V_o + V_r} \cdot T_n,$$

and $T_{min}$ satisfies the relation:

$$T_{min} = \frac{\left[V_o + \frac{p_{min}}{p_g} \cdot V_r\right]}{V_o + V_r} \cdot T_n,$$

it follows that the associated maximum and minimum temperatures $T_{max}$ and $T_{min}$ are 330.2° K. and 235.8° K., respectively.

Figure 5:
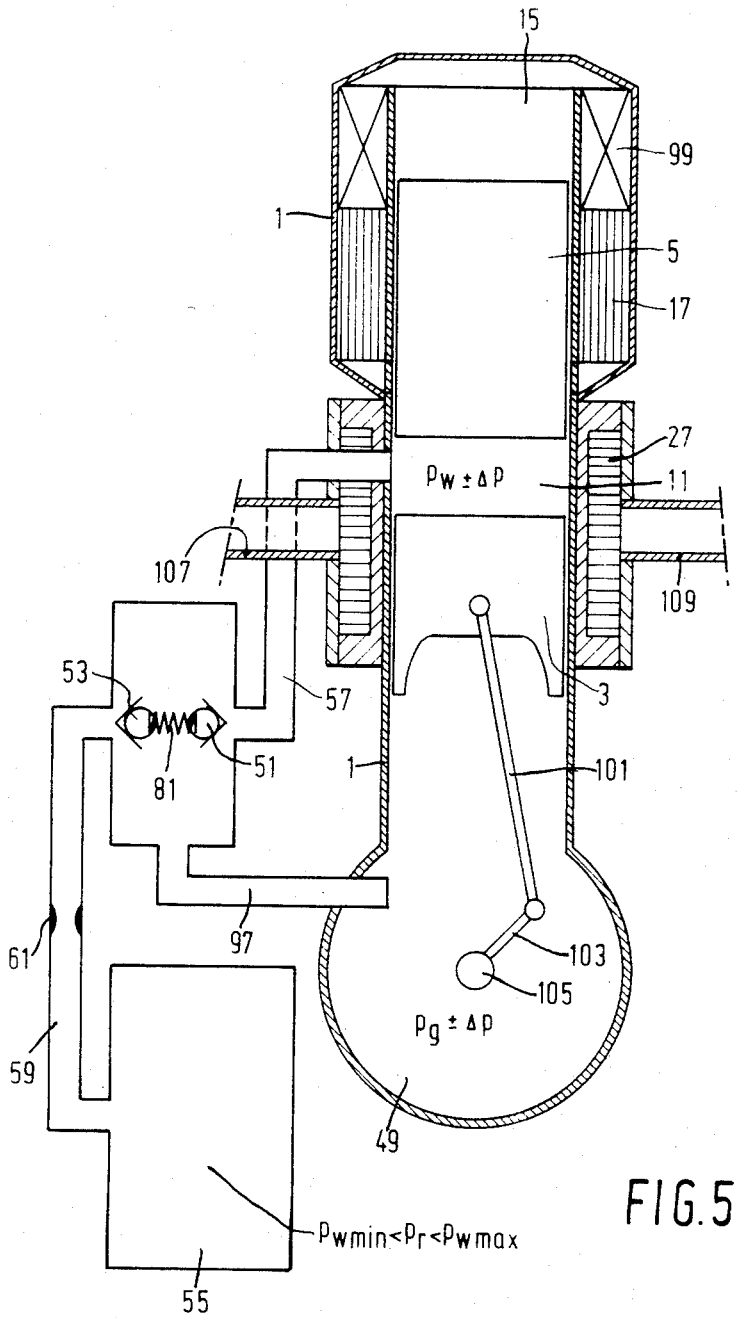
FIG. 5 is a diagrammatical sectional view of an oscillator constructed as a hot-gas engine (motor)

The further embodiment of an oscillator according to the invention shown in FIG. 5 is constructed as a hot-gas engine (motor). As far as possible, FIG. 5 is provided with the reference numerals corresponding to those of FIG. 1. In the oscillator of FIG. 5, the compression space 11 is kept at a comparatively low substantially constant temperature by the cooler 27. The expansion space 15 is kept at a comparatively high substantially constant temperature by a heater 99. The regenerator 17 is arranged between the housing 1 and the displacer 5. The piston is connected by means of a driving rod 101 to a crank rod 103 which is secured to a driving shaft 105 delivering mechanical work (not shown). A coolant is supplied to the cooler 27 through a supply pipe 107. The heated coolant is drained through a drain pipe 109. The pressure control of the hot-gas engine shown in FIG. 5 is completely analogous to the pressure control of the cold-gas engine shown in FIG. 1 and is therefore not described further.

In the pressure control described with the reference to FIGS. 1 to 5, it is assumed that the oscillators operate with the a constant pressure sweep. The control described is indeed particularly suitable for oscillators with the a constant pressure sweep. However, the control may also be used with the a variable pressure sweep. In the cold-gas engine shown in FIG. 1, a variable pressure sweep can be obtained with the a controllable frequency of the supply voltage for the coil 35. However, the situation may then arise that the working pressure does not become sufficiently high or sufficiently low to open the valves loaded with the a constant pre-stress and the reservoir pressure. In order to obtain nevertheless a compensation for pressure variations due to the ambient temperature, during operation with the too small a pressure sweep the pressure sweep is temporarily adjusted to the maximum value by controlling the supply voltage frequency of the coil 35. The process of blowing off and supplementation then takes place again in the manner described. In an analogous manner in the hot-gas engine shown in FIG. 5 the temperature of the heater 99 can be temporarily adjusted so that a maximum pressure sweep is obtained for a short period during the operation with the too small a pressure sweep to make it possible to blow off and to supplement.

An essentially different control in oscillators with the a variable pressure sweep is described hereinafter with the reference to the valve mechanisms shown in FIGS. 6 and 7. By means of these valve mechanisms, an automatic correction can be carried out for a variable pressure sweep in a given temperature range. In principle, this is effected by rendering the mechanical pre-stress of the valves dependent upon the difference between the nominal ambient temperature $T_n$ and the actually occurring ambient temperatures. The sum of the mechanical pre-stresses of the release valve and the supply valve then remains the same, however, whereas the ratio between the mechanical pre-stresses varies as a function of the ambient temperature.

Figure 6:
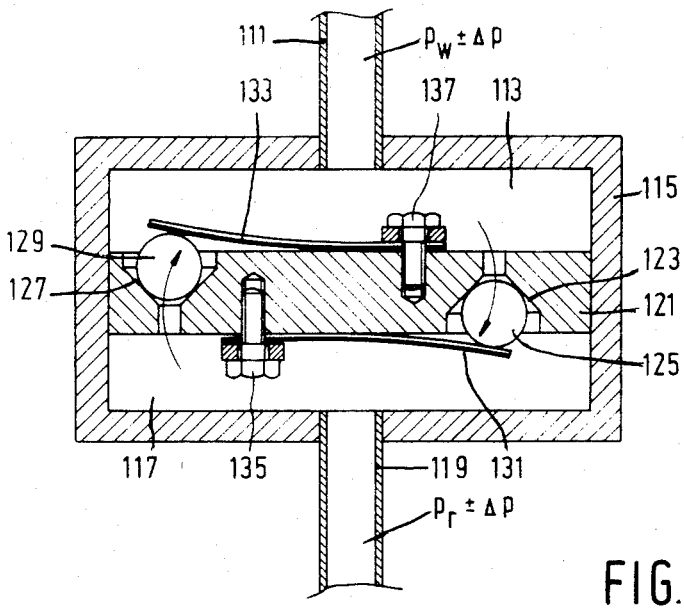
FIG. 6 shows in detail a sectional view of a valve mechanism comprising two bimetal springs used in the oscillators shown in FIGS. 1 or 5.

The valve mechanism illustrated with the reference to FIG. 6 has a pipe 111 which is connected at one end to the cooler 27 and the compression space 11, respectively, of an oscillator shown in one of FIGS. 1 or 5 and is connected at the other end to a first chamber 113 in a gas-tight cylindrical housing 115. A second chamber 117 in the housing 115 is connected through a pipe 119 to the reservoir 55. The first chamber 113 is separated from the second chamber 117 by a circular mounting plate 121. The mounting plate 121 is provided with the a conical valve seat 123 for a release valve (ball valve) 125 and with the a conical valve seat 127 for a supply valve 129. The release valve 125 and the supply valve 129 are identical to each other. The release valve 125 and the supply valve 129 are pre-stressed by bimetal springs 131 and 133, respectively, which are held by means of screws 135 and 137 onto the mounting plate 121. The mechanical pre-stress of the two bimetal springs 131 and 133 is the same at the nominal ambient temperature $T_n$. Due to the fact that the bimetal springs 131 and 133 are mounted in inverted positions with the respect to each other (see shaded area), a temperature increase leads to a stronger curvature of the bimetal spring 131 and a smaller curvature of the bimetal spring 133, whereas a temperature decrease leads to a larger curvature of the bimetal spring 133 and a smaller curvature of the bimetal spring 131. The sum of the two mechanical pre-stresses consequently remains the same, whereas the ratio of these stresses varies as a function of the ambient temperature. The housing 115 is made of a good heat-conducting material so that the bimetal springs invariably assume the ambient temperature.

Figure 8:
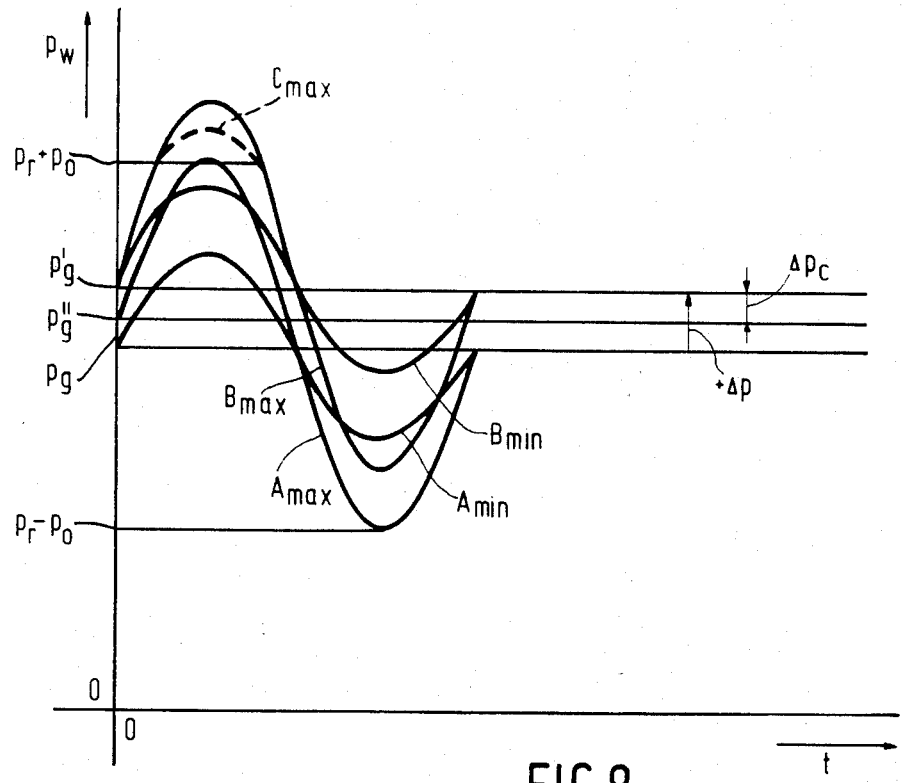
FIG. 8 is a graph in which the working pressure is plotted as a function of time for an oscillator of the kind shown in FIGS. 1, 5, 6 or 7 operating with the a varying pressure sweep at an increased ambient temperature.
Figure 9:
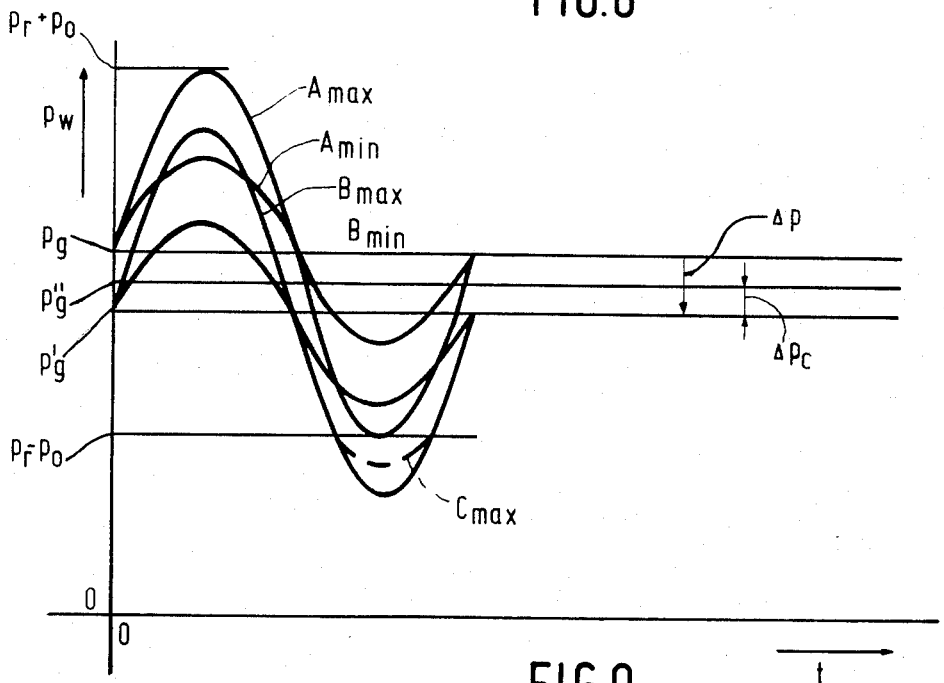
FIG. 9 is a graph in which the working pressure is plotted as a function of time for an oscillator of the kind shown in FIGS. 1, 5, 6 or 7 operating with the a varying pressure sweep at a decreased ambient temperature.

The operation of the valve mechanism shown in FIG. 6 is described with the reference to the graphs of FIGS. 8 and 9 in which the working pressure $p_w$ is plotted as a function of the time t for one operating cycle of the oscillator. FIG. 8 shows the situation with the an increase of the ambient temperature, bothe with the the maximum pressure sweep and with the the minimum pressure sweep. FIG. 9 shows the situation with the a decrease of the ambient temperature, likewise bothe with the the maximum pressure sweep and with the the minimum pressure range. It is assumbed that the average working pressure at the nominal temperature $T_n$ is equal to $p_g$. The curve $A_{max}$ relates to the maximum pressure sweep at the average working pressure $p_g$, while the curve $A_{min}$ relates to the minimum pressure sweep at the pressure $p_g$. Due to the increase of the ambient temperature above the value $T_n$, an increase $\Delta p$ of the average working pressure $p_g$ occurs. The new average pressure is indicated by $p_g'$. In the new situation, the curve $B_{max}$ relates to the maximum pressure sweep while the curve $B_{min}$ relates to the minimum pressure sweep. The pressure $p_r+p_o$, at which the release valve 125 was opened at the average working pressure $p_g$, lies at the same level also with the the pressure $p_g'$. In fact, due to the temperature increase the bimetal spring 131 is curved more strongly so that its pre-stress is reduced, while the pressure in the reservoir 55 is raised.

The effect of blowing-off is indicated in FIG. 8 for the maximum pressure sweep by the dotted curve $C_{max}$. The corrected average working pressure is indicated by $p_g''$ and the correction of $p_g'$ due to the blowing-off is indicated by $\Delta p_c$. It will be clear that with the following operating cycles the correction $\Delta p_c$ increases. Withe an ideally operating control, the maximum of $\Delta p_c$ is approximately equal to $\Delta p$. The operation of the supply valve 127 at a decreased ambient temperature and with the a maximum pressure sweep is indicated in FIG. 9 in the same way as in FIG. 8. FIG. 9 need therefore not be explained further.

It should be noted that with the a minimum pressure sweep $B_{min}$ the working pressure $p_w$ no longer reaches the level $p_r+p_o$ required for blowing off at the ambient temperature which resulted in the pressure increase $\Delta p$. Only at a higher ambient temperature, blowing off would take place again with the a minimum pressure sweep. However, blowing off may alternatively be effected by temporarily increasing the pressure sweep with the the amplitude control so that the pressure $p_o+p_r$ is exceeded again. The same prodecure applies to supplementation.

Figure 7:
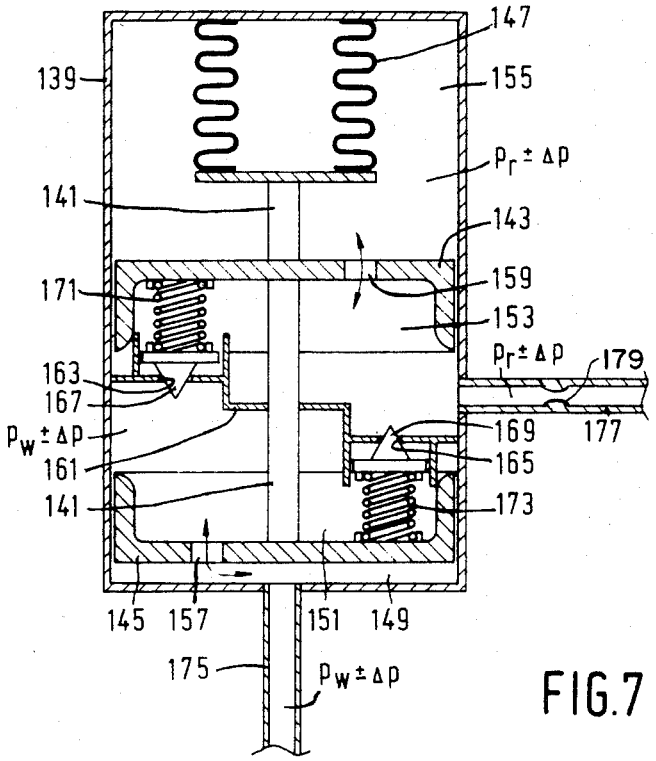
FIG. 7 shows in detail a sectional view of a valve mechanism comprising two mechanical helical springs used in the oscillators shown in FIGS. 1 or 5.

The valve mechanism shown in FIG. 7 is arranged in a gas-tight cylindrical housing 139. The housing 139 accommodates a displaceable operating member which is constituted by a rod 141 to which are secured two circular cups 143 and 145, which are guided along the inner wall of the housing 139. The rod 141 is further connected to a bellows 147 in which a vacuum prevails. The housing 139 comprises four chambers 149, 151, 153 and 155. The chambers 149 and 151 are in open communication with the each other through an opening 157 in the cup 145, while the chambers 153 and 155 are in open communication with the each other through an opening 159 in the cup 143. The chambers 149 and 151 are mutually separated by a partition wall 161. The partition wall 161 is provided with the two seats 163 and 165 for a release valve 167 and a supply valve 169, respectively. The release valve 167 and the supply valve 169 are pre-stressed by mechanical helical springs 171 and 173, respectively, which are supported by the cup 143 and the cup 145. The pre-stress of the two valves is the same, just like the stiffness of the two compression springs. The rod 141 is secured to the bellows 147. A pipe 175 is connected at one end to the working space of the oscillator and is connected at the other end to the chamber 149. The chamber 153 is connected to the reservoir 55 via a pipe 177 which is provided with the a restriction 179.

With an increase of the ambient temperature above the nominal value $T_n$, the working pressure $p_w$ is increased by an amount $\Delta p$ to a pressure $p_w+\Delta p$. Due to the opening 157 in the cup 145, a pressure $p_w+\Delta p$ prevails therefore also in the chamber 151 so that no resultant force is exerted on the cup 145 and the rod 141. Since the reservoir 55 is likewise exposed to the surrounding atmosphere, the pressure in the reservoir 55 will also be increased by $\Delta p$. The pressure $p_r+\Delta p$ prevails in the chambers 153 and 155 so that no resultant force in exerted on the cup 143 and the rod 141. Since a vacuum continuously prevails in the bellows 147, a pressure difference $p_r+\Delta p$ will occur across the bellows due to the pressure increase $\Delta p$ in the chambers 153 and 155 so that a resultant force is exerted through the bellows 147 on the rod 141. This force is a function of $\Delta p$ and hence also a function of the temperature increase at the atmosphere surrounding the oscillator. The rod 141 will consequently move upwards, as a result of which the pre-stress of the supply valve 169 is increased, whereas the pre-stress of the release valve 167 is decreased. Blowing-off can now take place from the working space through the release valve 167 to the reservoir 55 because the pressure $p_w+\Delta p$ in the working space sufficiently exceeds the reservoir pressure $p_r+\Delta p$ ($p_w>p_r+p_o$). This is the case during a number of successive operating cycles so that the overall pressure correction $\Delta p_c$ is ultimately substantially equal to $\Delta p$. An analogous consideration applies to the case in which the ambient temperature decreases below the nominal ambient temperature $T_n$. FIGS. 8 and 9 are therefore also applicable to the valve mechanism shown in FIG. 7.

Although the oscillator according to the invention has been described with the reference to a cold-gas engine and a hot-gas engine shown in FIGS. 1 and 5, it is not limited thereto. For example, the engine shown in FIG. 1 may be operated as a current generator if the expansion space 15 is kept at a comparatively high temperature and the compression space 11 is kept at a comparatively low temperature. The engine shown in FIG. 5 may be operated as a cold-gas engine if the shaft 105 is driven, while the expansion space 15 is kept at a comparatively low temperature and the compression space 11 is kept at a comparatively high temperature. Bothe the engine shown in FIG. 1 and the engine shown in FIG. 5 may be operated as a heat pump. In this case, the temperature of the expansion space 15 has to be below the ambient temperature, while the temperature of the compression space 11 has to be above the ambient temperature.

In general, it may be said that the oscillator according to the invention can produce bothe cold and heat or can deliver mechanical work. An oscillator of the so-called Vuilleumeir type comprising two free displacers and two re-generators may also be used with the the pressure control described. The term "free displacer" is to be understood to mean a displacer which is kept by thermodynamic pressure fluctuations at the resonance frequency with the a fixed phase difference between the movement of the piston and the movement of the displacers. Oscillators with the a fixed phase difference between piston and displacers obtained by a mechanical transmission do not lie within the scope of the invention. It should be noted that displacers which are coupled via a spring to the housing and/or piston are also considered to be free displacers. Such free displacers have been described, for example, in the aforementioned U.S. Pat. No. 3,991,585.

What is claimed is:

1. A thermodynamic oscillator having at least one displacer which is displaceable in a working space filled with the working medium at the resonant frequency of the oscillator and which divides the working space into an expansion space and a compression space of different substantially constant temperatures, which expansion and compression spaces communicate with the each other through a regenerator, the movement of the displacer due to pressure fluctuations in the working medium being coupled to a member which is also displaceable in the working space, said working space being connected through at least one release valve having a mechanical pre-stress and at least one supply valve having a mechanical pre-stress to at least one reservoir which is filled with the the same working medium as that of the working space and whose pressure lies between a maximum and a minimum working pressure of the working medium, characterized in that the release valve and the supply valve are arranged in the connection between one simple reservoir and the working space, and said oscillator comprises means for varying bothe the opening pressure of the release valve and the opening pressure of the supply valve as a function of the ambient temperature, the opening pressure of the release valve being equal to the sum of the mechanical pre-stress of the release valve and the reservoir pressure, and the opening pressure of the supply valve being equal to the difference between the reservoir pressure and the mechanical pre-stress of the supply valve.

2. An oscillator as claimed in claim 1, characterized in that the sum of the mechanical pre-stress of the release valve and the mechanical pre-stress of the supply valve is constant.

3. An oscillator as claimed in claim 2, characterized in that said means comprises a single mechanical spring arranged to pre-stress bothe the release valve and the supply valve, and the connection between the working space and the reservoir includes a restriction.

4. An oscillator as claimed in claim 3, characterized in that said means further comprises an operating slide, a first bellows secured near one end of said slide, and a second identical bellows secured near the other end of said slide, arranged such that the same pressure prevails inside the two bellows, the working or average working pressure prevails outside the first bellows, and the second bellows is surrounded by an evacuated space.

5. An oscillator as claimed in claim 2, characterized in that said means varies the ratio between the two mechanical pre-stresses as a function of the difference between a nominal value of the ambient temperature and the actually occurring ambient temperature.

6. An oscillator as claimed in claim 5, characterized in that said means includes a respective individual mechanical spring arranged to pre-stress each of the valves, the stiffness of the two springs being equal.

7. An oscillator as claimed in claim 6, characterized in that each of said mechanical springs is a bimetal spring which is in heat-exchanging contact with the the ambient atmosphere.

8. An oscillator as claim in claim 7, characterized in that said means comprises a bellows to which each of the two springs are coupled, and an operating member arranged to cooperate with the said bellows, said bellows having an interior vacuum and being exposed at its outside to the pressure of the reservoir.

9. An oscillator as claimed in claim 1, characterized by being a cold-gas engine, said displacer being a free displacer which divides the work space into a compression space of comparatively high temperature and an expansion space of comparatively low temperature; said member being a piston, the movement of the free displacer being coupled to the piston by pressure fluctuations in the working medium; and comprising a linear electric motor arranged to drive the piston.

10. An oscillator as claimed in claim 1, characterized by being a hot-gas engine, said displacer being a free displacer which divides the working space into a compression space of comparatively low temperature and an expansion space of comparatively high temperature; said member being a piston, the movement of the free displacer being coupled to the piston by pressure fluctuations in the working medium; and said piston being arranged for coupling to a mechanical load.

* * * * *

UNITED STATES PATENT AND TRADEMARK OFFICE

CERTIFICATE OF CORRECTION

PATENT NO. : 4,498,296

DATED : February 12, 1985

INVENTOR(S) : KEES DIJKSTRA ET AL

It is certified that error appears in the above—identified patent and that said Letters Patent is hereby corrected as shown below:

Claim 1, line 3, before "working" delete "the"

line 7, before "each" delete "the"

line 23, (Col. 12, line 16) change "bothe" to --both--

Claim 3, line 3, change "bothe" to --both--

Claim 8, line 4, before "said" delete "the"

Signed and Sealed this

*Twenty-eighth* Day of *May 1985*

[SEAL]

*Attest:*

DONALD J. QUIGG

*Attesting Officer* *Acting Commissioner of Patents and Trademarks*